United States Patent [19]

Koog

[11] Patent Number: 4,605,423

[45] Date of Patent: Aug. 12, 1986

[54] APPARATUS FOR GENERATING AND COOLING SYNTHESIS GAS

[75] Inventor: Wolfgang Koog, Pleasantville, N.Y.

[73] Assignee: Texaco Development Corporation, White Plains, N.Y.

[21] Appl. No.: 629,149

[22] Filed: Jul. 9, 1984

Related U.S. Application Data

[62] Division of Ser. No. 367,821, Apr. 12, 1982, Pat. No. 4,466,808.

[51] Int. Cl.[4] ..... C10J 3/48; C10J 3/84

[52] U.S. Cl. ..... 48/69; 48/DIG. 2; 55/223; 55/256

[58] Field of Search ..... 48/69, 77, 128, DIG. 2; 55/244, 267, 256, 223; 422/207

[56] References Cited

U.S. PATENT DOCUMENTS

| | | | |
|---|---|---|---|
| 2,767,806 | 10/1956 | Blake | 55/223 |
| 2,931,715 | 4/1960 | Eastman et al. | 48/206 |
| 2,971,830 | 2/1961 | Kawai et al. | 48/206 |
| 4,074,981 | 2/1978 | Slater | 48/197 R |
| 4,218,423 | 8/1980 | Robin et al. | 422/207 |

FOREIGN PATENT DOCUMENTS

| | | | |
|---|---|---|---|
| 2033563 | 5/1980 | United Kingdom | 48/DIG. 2 |
| 0797736 | 1/1981 | U.S.S.R. | 55/244 |

*Primary Examiner*—Peter Kratz

*Attorney, Agent, or Firm*—Robert A. Kulason; Carl G. Seutter

[57] ABSTRACT

Hot gases containing ash and char which pass through an undesirable viscous, sticky phase on cooling through an intermediate temperature range, are cooled in a first cooling zone including a falling film of cooling liquid and a spray of cooling liquid followed by contact with a body of cooling liquid and subsequent mixing therewith.

3 Claims, 5 Drawing Figures

APPARATUS FOR GENERATING AND COOLING SYNTHESIS GAS

This is a division of application Ser. No. 367,821, filed Apr. 12, 1982, now U.S. Pat. No. 4,466,808, issued Aug. 21, 1984.

Field of the Invention

This invention relates to a novel cooling apparatus and to a method of cooling. More particularly it relates to a technique for cooling a hot gas containing particles which undesirably pass through a viscous, sticky phase on cooling.

BACKGROUND OF THE INVENTION

As is well known to those skilled in the art, it is difficult to satisfactorily cool hot gases, typically at temperatures as high as 1200° F. or higher and particularly so when these gases contain particulates including ash and char. Typical of such gases may be a synthesis gas prepared as by incomplete combustion of a solid carbonaceous charge. The principal desired gas phase components of such a mixture may include carbon monoxide and hydrogen; and other gas phase components may be present including nitrogen, carbon dioxide, and inert gases. The synthesis gas so prepared is commonly found to include non-gaseous components including those identified as ash, which is predominantly inorganic, and char which is predominantly organic in nature and includes carbon.

These non-gaseous components are entrained or dispersed in the synthesis gas as solid or near solid particles typically having a particle size in the 1–10,000 micron range. The troublesome ash portions are typically of particle size less than 10–50 microns. At the temperature at which the synthesis gas is generated, usually 1800° F.–3500° F. several of the components of the ash are typically above their melting point and the ash may in fact be made up of a mixture of solid and molten fractions. The char component is also characterized by its viscous, near liquid, semimolten nature.

The presence of these particles, which pass through an undesirable viscous, sticky phase on cooling to lower temperature of typically 300° F.–520° F., introduces problems. As the particles are passed through the various conduits and coolers, the particles adhere to the surfaces with which they come into contact and in due course block the passageways through the cooler thereby rendering the cooler inoperative. Plugging of the various passageways through which the gas is to pass causes serious problems ranging from increase in pressure drop to complete blockage of the apparatus; in this latter instance, the possibility of damage to the apparatus is present due to undesirable increase in temperature and pressure. Even under the most favorable conditions, it would be undesirably necessary to shut down the apparatus for the purpose of cleaning out the deposits of the viscous and sticky solids.

It is an object of this invention to provide a novel process and apparatus for cooling a hot synthetis gas containing particles including ash and char which pass through an undesirable viscous, sticky phase on cooling through an intermediate temperature range.

STATEMENT OF THE INVENTION

In accordance with certain of its aspects, the novel quench chamber of this invention comprises an attenuated dip tube having inner and outer perimetric surfaces, an axis, and an inlet end and an outlet end;

a quench ring adjacent to the inner perimetric surface at the inlet end of said dip tube, said quench ring having a fluid inlet;

a first fluid outlet on said quench ring adapted to direct a curtain of fluid along the inner perimetric surface of said attenuated dip tube and toward the outlet end of said dip tube;

spray means in said dip tube for directing a stream of fluid away from the inner perimetric surface of said attenuated dip tube;

the first fluid outlet and said spray, as the charge gas passes and a quench chamber surrounding said attenuated dip tube forming a closed chamber therearound, and including a quenched gas outlet adjacent to the inlet end of said attenuated dip tube, and a quench bottoms liquid outlet in said quench chamber adjacent to the outlet end of said attenuated dip tube;

whereby charge gas admitted to the inlet end of said attenuated dip tube may be contacted with liquid from the first fluid outlet and said spray, as the charge gas passes along the axis of said attenuated dip tube, and thereafter into a body of liquid maintained in said quench chamber and having a liquid level in said attenuated dip tube, said charge gas leaving said dip tube passing through the annular passageway between the outside of the outer perimetric surface of the attenuated dip tube and the inside of the inner perimetric surface of the quench chamber, and thence to the quench gas outlet of said quench chamber.

In accordance with certain of its preferred aspects, the novel quench chamber of this invention comprises an attenuated dip tube having inner and outer perimetric surfaces, an axis, an inlet end and an outlet end;

a quench ring adjacent to the inner perimetric surface at the inlet end of said dip tube, said quench ring having a cooling fluid-inlet;

a first fluid outlet on said quench ring adapted to diect a curtain of fluid along the inner perimetric surface of said attenuated dip tube and toward the outlet end of said dip tube;

a second fluid outlet on said quench ring adapted to direct a stream of fluid away from the inner perimetric surface of said attenuated dip tube;

and a quench chamber surrounding said attenuated dip tube forming a closed chamber therearound, and including a quenched gas outlet adjacent to the inlet end of said attenuated dip tube, and a quench bottoms liquid outlet in said quench chamber adjacent to the outlet end of said attenuated dip tube;

whereby charge gas admitted to the inlet end of said attenuated dip tube may be contacted with liquid from the first and second fluid outlets, as the charge gas passes along the axis of said attenuated dip tube, and thereafter into a body of liquid maintained in said quench chamber and having a liquid level in said attenuated dip tube said charge gas leaving said dip tube passing through the passageway between the outside of the outer perimetric surface of the attenuated dip tube and the inside of the inner perimetric surface of the quench chamber, and thence to the quench gas outlet of said quench chamber.

DESCRIPTION OF THE INVENTION

The charge hot synthesis gas which may be charged to the process of this invention may be a synthesis gas prepared by the gasification of coal. In the typical coal gasification process, the charge coal which has been finely ground typically to an average particle size of 20–500 microns preferably 30–300, say 200 microns may be slurried with an aqueous medium, typically water, to form a slurry containing 40–80 w %, preferably 50–75 w %, say 60 w % solids. This aqueous slurry may then be admitted to a combustion chamber wherein it is contacted with oxygencontaining gas, typically air, to effect incomplete combustion. The atomic ratio of oxygen to carbon in the system may be 0.7–1.2:1, say 0.90:1. Typically reaction is carried out at 1800° F.–3500° F., say 2500° F. and pressure of 100–1500 psig, preferably 500–1200 psig, say 900 psig.

Under these typical conditions of operation, the synthesis gas commonly contains (dry basis) 35–55 v %, say 50 v % carbon monoxide, 30–45 v %, say 38 v % hydrogen; 1020 v %, say 12 v %, carbon dioxide, 0.3 v %, say 0.8 v % hydrogen sulfide; 0.4–0.8 v %, say 0.6 v % nitrogen; and methane in amount less than about 0.1 v %.

Depending on the quality and composition of the charge coal, the coal may contain ash in amount of as little as 0.5 w % or as much as 40 w % or more. This ash is found in the product synthesis gas. Generally the ash components (typically inorganic oxides, silicates, etc.) may have a melting point of 1800° F. or above; and if they are cooled through an intermediate temperature range, they are commonly found to be viscous and sticky. This viscous-sticky range may extend from below the theoretical melting point to above the melting point. It may commonly be 1000° F.–2000° F., preferably 1100° F.–1400° F.

The product synthesis gas may also be found to contain an organic component referred to as char. This component which includes principally carbon and high-boiling hydrocarbons typified by asphalts and tars, may at the temperatures through which the synthesis gas passes as it is cooled, be viscous and sticky.

Insofar as the process of the instant invention is concerned, these ash and char components may be generally considered together as having the undesirable characteristic that, as the gas in which they are contained is cooled through a temperature range between that at which synthesis gas is prepared and that to which it is cooled prior to further handling, the ash and char components assume undesirable viscous and sticky properties. This temperature range may vary depending on the charge coal and the treatment to which it is subjected prior to gasification. Generally however, it is found that this temperature range may have as its upper boundary 1400°–2000° F. The lower boundary of the undesirable range may be 1000° F.–1100° F.

Effluent from the reaction in which coal is gasified to produce synthesis gas may be 1800° F.–3500° F. preferably 2000° F.–2800° F., say 2500° F. at 100–1500 psig, preferably 500–1200 psig, say 900 psig.

The apparatus which may be used in practice of this invention may include a gas generator such as is generally set forth in the following patents inter alia:

| | |
|---|---|
| USP 2,818,326 | Eastman et al |
| USP 2,896,927 | Nagle et al |
| USP 3.998.609 | Crouch et al |
| USP 4,218,423 | Robin et al |

In accordance with practice of this invention, the hot synthesis gases containing ash and char are passed downwardly through a first contacting zone. The upper extremity of the first contacting zone may be defined by the lower outlet portion of the reaction chamber of the gas generator. The first contacting zone may be generally defined by an upstanding preferably vertical perimeter wall; and the cross-section of the zone formed by the wall is in the preferred embodiment substantially cylindrical. The outlet or lower end of the first contact zone may be defined as the lower extremity of the preferably cylindrical wall of the first contact zone.

The first contacting zone is preferably bounded by a vertically extending, cylindrical dip tube which has its axis colinear with respect to the combustion chamber.

At the upper extremity of the first contacting zone or dip tube, there is mounted a quench ring through which cooling liquid, commonly water is admitted to the first contacting zone. From the quench ring there is directed a first stream of cooling liquid which in the preferred embodiment is directed toward the inner surface of the dip tube to which it forms a preferably continuous downwardly descending film of cooling liquor. Inlet temperature of the cooling liquor may be 100° F.–500° F., preferably 300° F.–480° F., say 450° F. The cooling liquor is admitted to the falling film on the wall of the dip tube in amount of 1–7, preferably 3–5, say 4 pounds per hour per thousand cubic feet (STP) of gas admitted to the first contacting zone.

As the falling film of cooling liquor contacts the downwardly descending hot synthesis gas, the temperature of the latter may drop by 200° F.–500° F. preferably 300° F.–400° F., say 350° F. because of contact with the falling film alone during its passage through the first contacting zone.

In accordance with practice of the process of this invention, there is also introduced into the first contacting zone, preferably at the upper extremity thereof, a spray of cooling liquid. This spray is admitted, preferably in a direction normal to the inside surface of the dip tube (i.e. in a direction toward the axis of the dip tube). The intimate contact of the sprayed liquid and the descending synthesis gas as the latter passes through the first contacting zone insures a higher level of heat and mass transfer and resultant cooling of the synthesis gas than is the case if the same total quantity of cooling liquid be passed downwardly as a film on the wall.

It is however particularly unexpected that by the use of this spray of cooling liquid, it is possible to cool the descending gas so that the ash and char components pass through the viscous-sticky temperature range of about 1000° F.–2000° F. in time which is less than about 10 seconds commonly 1–5 seconds, say 3 seconds. Thus the ash and char contained in the synthesis gas which leaves the first contacting zone is at temperature below that (about 1000° C.) at which the viscous-sticky properties are manifested; and plugging of downstream areas is minimized.

The amount of liquid sprayed into the first contacting zone is about 20–50 w %, preferably 25–40 w %, say 30 w % of the total admitted to that zone. Because of the high degree of contact between gas and liquid, the temperature of the gas may have dropped by 600° F.–1300° F. preferably 800° F.–1200° F., say 1100° F. during passage through the zone. This, it will be noted, is substantially greater than for the falling film alone without the spray.

It is a particular feature of this invention that when the same total amount of cooling liquid is admitted to a film and as a spray to the first contacting zone, the temperature drop across that zone is 800° F.-1200° F., say 1100° F. greater than when all the cooling liquid is admitted only as a film.

The lower end of the first contacting zone is submerged in a pool of liquid formed by the collected cooling liquid. The liquid level, when considered as a quiescent pool, may typically be maintained at a level such that 10%-80%, say 50% of the first contacting zone is submerged. It will be apparent to those skilled in the art that at the high temperature and high gas velocities encountered in practice, there may of course be no identifiable liquid level during operation—but rather a vigorously agitated body of liquid.

The hot gases and the cooled ash and char leave the bottom of the first contacting zone at typically 900° F.-1000° F. and they pass through the body of cooling liquid and under the lower typically serrated edge of the dip tube. The ash and char falls through the body of cooling liquid where they are retained and collected and may be drawn off from a lower portion of the body of cooling liquid.

The gases leaving the bottom of the first contacting zone—dip tube, are preferably passed together with cooling liquid upwardly through an annular passageway toward the gas outlet of the quench chamber. In one preferred embodiment, the annular passageway is defined by the outside surface of the dip tube forming the first cooling zone and the inside surface of a draft tube which envelops or surrounds the dip tube and which is characterized by a larger radius than that of the dip tube. Preferably the draft tube extends downwardly within the quench chamber to a level below that at which the lower extremity of the dip tube terminates.

As the mixture of cooling liquid and synthesis gas passes upwardly through the annular second cooling zone, the two phase flow therein effects efficient heat transfer from the hot gas to the cooling liquid: the vigorous agitation in this second cooling zone minimizes deposition of the particles on any of the contacted surfaces. Typically the cooled gas exits this annular second cooling zone at temperature of 300° F.-520° F., preferably 350° F.-500° F., say 450° F.

It is a feature of the preferred aspects of this invention that the cooled exiting gas and cooling liquor is passed (by the velocity head of the stream) into contact with a portion, typically the underside, of the quench ring through which the entering cooling liquid is admitted to the system.

As the cooled gas exits the second cooling zone, it is preferably slowed in velocity and passed through a convoluted or tortuous path to assist in separating entrained cooling liquid which is returned to the body of cooling liquid in the lower portion of the quench chamber. The cooled gas may be withdrawn, preferably from the upper portion of the quench chamber at 300° F.-520° F., preferably 350° F.-500° F. say 450° F.

Cooling liquid may be withdrawn as quench bottoms from the lower portion of the quench chamber; and the withdrawn cooling liquid will contain the solidified ash and char in the form of small particles. If desired, additional cooling liquid may be admitted to the body of cooling liquid in the lower portion of the quench chamber.

It will be apparent that the cooling which is carried out within the confines of the quench chamber is efficient in that (i) it effects cooling of the gas under conditions such that the ash and char passes quickly through the viscous-sticky temperature range, (ii) it permits removal of these solids from the gas, (iii) it provides high efficiency of cooling of the gas (iv) it permits efficient internal cooling of the apparatus by directing the flow of the several streams.

DESCRIPTION OF PREFERRED EMBODIMENTS

Figure 1:
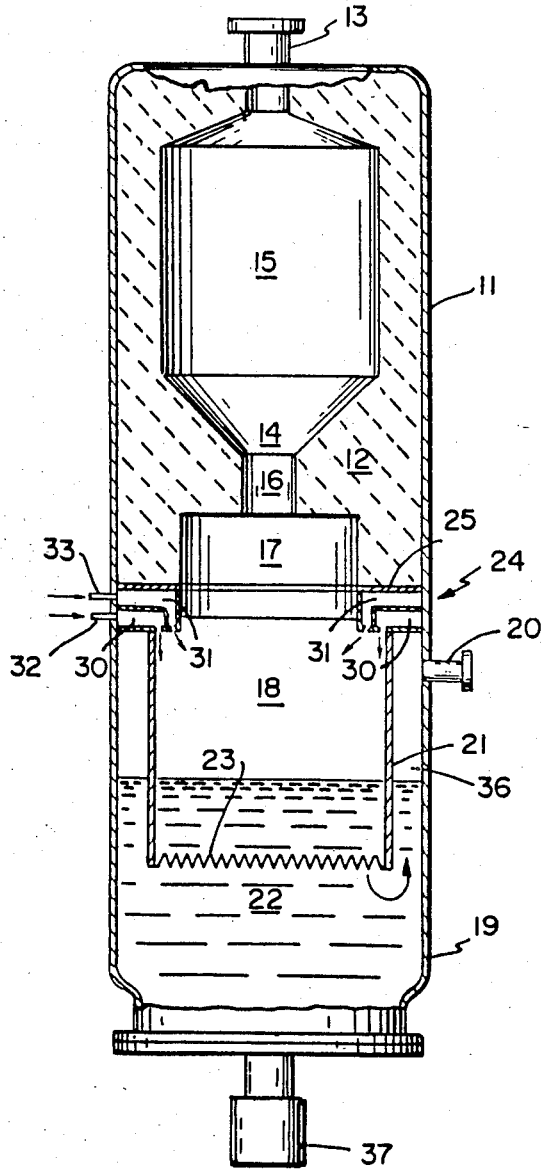
FIG. 1 is a schematic vertical section illustrating a generator and associated therewith a quench chamber and dip tube assembly.

Practice of this invention will be apparent to those skilled in the art from the following examples.

EXAMPLE I

In this Example which represents the best mode of the invention known to me at this time, there is provided a reaction vessel 11 having a refractory lining 12 and an inlet 13. The reaction chamber 15 has an outlet portion 14 which includes a narrow throat section 16 and an enlarged opening 17. Opening 17 is connected with first contacting zone 18 inside of dip tube 21. The lower extremity of dip tube 21, which bears serrations 23, is immersed in bath 22 of quench liquor. The quench chamber 19 includes, preferably at an upper portion thereof a gas discharge conduit 20.

It is a feature of the invention that there is mounted a quench ring 24 under the floor 25 of the upper portion of the reaction vessel 11. This quench ring which is shown in greater detail in FIG. 2, may include an upper surface 26 which preferably rests against the lower portion of the floor 25. A lower surface 27 of the quench ring preferably rests against the upper extremity of the dip tube 21. The inner surface 28 of the quench ring may be coterminous with the edge of opening 17.

In the preferred embodiment, the quench ring 24 may be divided by an internal wall 29 which divides the quench ring into a film chamber 30 and a spray chamber 31 bearing respectively inlet nozzles 32 and 33.

Film chamber 30 includes outlet nozzle 34 which may be in the form of a series of holes or nozzles around the periphery of quench ring 24—positioned immediately adjacent to the inner surface of dip tube 21. The liquid projected through passageway or nozzle 34 passes in a direction generally parallel to the axis of the dip tube 21 and forms a thin falling film of cooling liquid which descends on the inner surface of dip tube 21.

Spray chamber 31 includes outlet nozzle 35 which may be in the form of a series of holes or nozzles around the periphery (but closer to the axis of dip tube 21 than are the film outlet nozzles 34) of quench ring 24. The liquid projected through the schematically represented spray nozzles 35 passes in a direction which preferably has a substantial component toward the axis of the dip tube 21; and in a preferred embodiment, the spray nozzles may be positioned in a circle on the quench ring, around the axis of the dip tube toward which they point.

Figure 2:
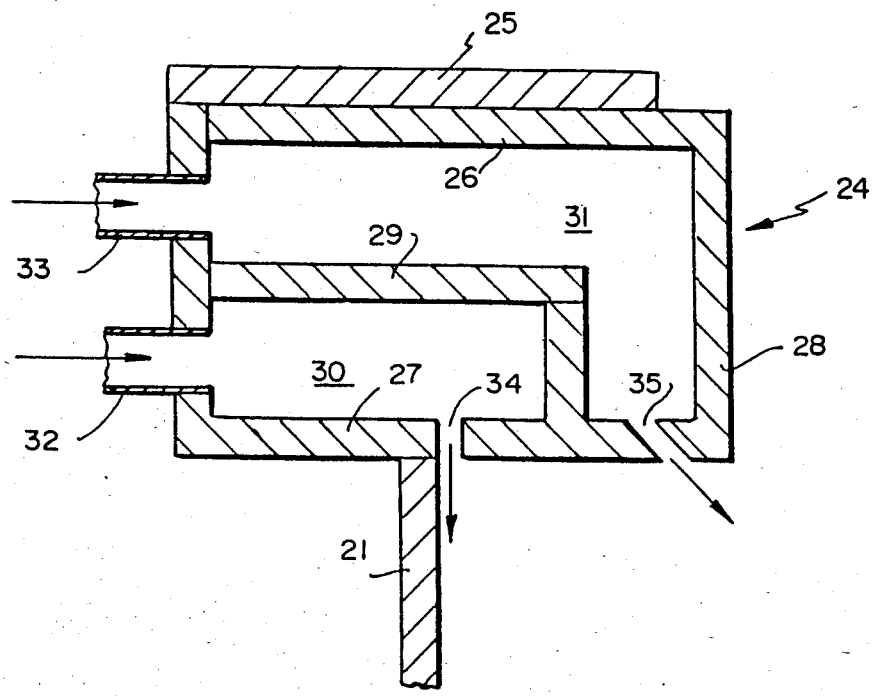
FIG. 2 is a detailed schematic vertical section illustrating details of one embodiment of the quench ring of FIG. 1.

In operation of the process of this invention using the apparatus of FIG. 1–2, a slurry containing 100 parts by weight of coal (per unit time) and 60 parts by weight of water is admitted through inlet 13. The coal has been ground to an average particle size of 200 microns. There is also admitted through inlet 13, 90 parts by weight of oxygen. Combustion in reaction chamber 15 raises the temperature to 2500° F. Product synthesis gas, passed through outlet portion 14 of reaction chamber 15 and throat 16 and enlarged portion 17 may contain the following gaseous components:

| Component | Wet Basis volume % | Dry Basis v % |
|---|---|---|
| CO | 38.6 | 48.5 |
| $H_2$ | 30.5 | 38 |
| $CO_2$ | 9.6 | 12 |
| $H_2O$ | 20 | — |
| $H_2S$ | 0.8 | 1 |
| $N_2$ | 0.4 | 0.5 |
| $CH_4$ | <0.08 | <0.1 |

This synthesis gas may also contain about 5 pounds of solid (char and ash) per 1000 SCF dry gas.

The product synthesis gas leaving the enlarged opening 17 in amount of 235 parts by weight is admitted to first contact zone 18. Here it is contacted with cooling liquid which is typically water. A first portion of the cooling liquid is passed through conduit 32 into film chamber 30 and thence through outlet nozzle 34 onto the inside of the inner surface of dip tube 21. Here it forms a falling film of cooling liquid which covers the inner surface of the dip tube.

There is also admitted to the quench ring 24 through line 33 and spray chamber 31 a second portion of cooling liquid. This portion of liquid is admitted to the first contacting zone 18 through spray conduit or nozzle 35. The spray exiting nozzle 35 is directed downwardly and preferably toward the principal axis of the dip tube.

The cooling liquid admitted through inlet conduit 34 is 60 w % of the total cooling liquid admitted and the cooling liquid admitted through spray nozzle 35 is 40 w % of the total cooling liquid admitted.

The high degree of turbulence in the first contact zone and the combination of cooling through film evaporation and through spray cooling is sufficient to effect cooling of the downwardly descending synthesis gas from its initial temperature of 2500° F. down to a temperature at the outlet of the dip tube—first cooling zone which is below about 1400° F. and typically about 900° F.–1000° F. It is a particular feature of the process of this invention because of the intimate cooling effected in the first cooling zone, that the ash and char components of the synthesis gas are cooled sufficiently quickly so that they pass through the sticky-viscous range (of 1100° F.–1400° F.) in less than 3 seconds and are thus in solid state by the time they reach the lower extremity of the dip tube.

A control system which used the same total amount of cooling liquid (under conditions otherwise comparable but without using spray nozzles 35) passing through nozzle 34 and present as a film, does not cool the ash and char so quickly or to so low a temperature, and as a result, the ash and char are found to be in the sticky-viscous range at the bottom of the dip tube. This has been found to be undesirable in that these particles adhere to metal surfaces and build up a deposit which plugs the apparatus to the point at which frequent shut down is necessary.

The synthesis gas leaving the lower portion of the first contact zone passes through a body of liquid 22. It will be apparent that the body will not be quiescent with a well defined liquid level (which is a static representation) but that it will be in a state of agitation. As the synthesis gas passes through the bath of quench liquid, a substantial portion (typically up to 95%) of the ash and char particles drop out of the gas, at or near the lower terminus of the first contacting zone.

The synthesis gas, now at 1000° F. and 950 psig, is passed upwardly together with cooling water through annular second cooling zone 36. As the synthesis gas passes upwardly in mixed vapor-liquid flow in zone 36, cooling water is vaporized and gas is cooled. Typically the temperature at the outlet from the second contact zone is 400° F.–500° F.

As the upflowing mixture of gas and vaporizing water passes upwardly and leaves the second contacting zone, it is directed by the velocity head against a portion of the quench ring; and this provides a cooling effect which permits the quench ring to be maintained at desired low temperature as measured on its lower surface.

Solid particles of ash and char may be withdrawn through line 37 and additional cooling liquid may if desired be admitted to the body of quench liquid through a conduit (not shown).

The temperature of the cooled synthesis gas in gas discharge conduit 37 is typically about 450° F. and the content of undesirable solids is typically below 5% of the total solids in the gas leaving the combustion chamber.

EXAMPLE II

Figure 3:
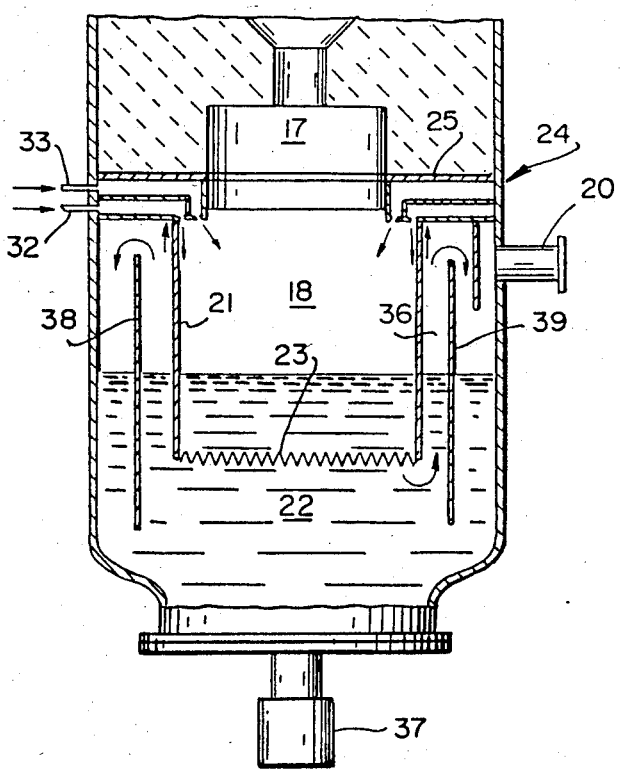
FIG. 3 is a schematic vertical cross-section illustrating an alternative embodiment of a generator and associated therewith a quench chamber and dip tube assembly.

There is set forth in FIG. 3 an alternative embodiment of the apparatus of FIG. 1, only the lower cooling portion being shown in detail. The embodiment of FIG. 3 may be preferred when the amount or nature of the gas or the particles in the gas is such that additional or more intensive cooling of the gas is required.

In FIG. 3, the cooling apparatus includes a draft tube 38 which in this embodiment confines the second cooling zone therewithin. By the ability to design a second cooling zone with a wider or narrower cross-section (and the ability to provide more or less contact with cooling liquid by adjusting the rest height of the upper surface of the bath of quench liquid) it is possible to obtain cooling times of desired degree.

In the embodiment of FIG. 3, the turbulent stream leaving the upper extremity of the second cooling zone 36 is directed into contact with the underside of the quench ring 24 and thence outwardly and downwardly toward exit 20. As it passes under baffle 39 liquid water may be centrifugally withdrawn from the exiting gas stream.

EXAMPLE III

Figure 4:
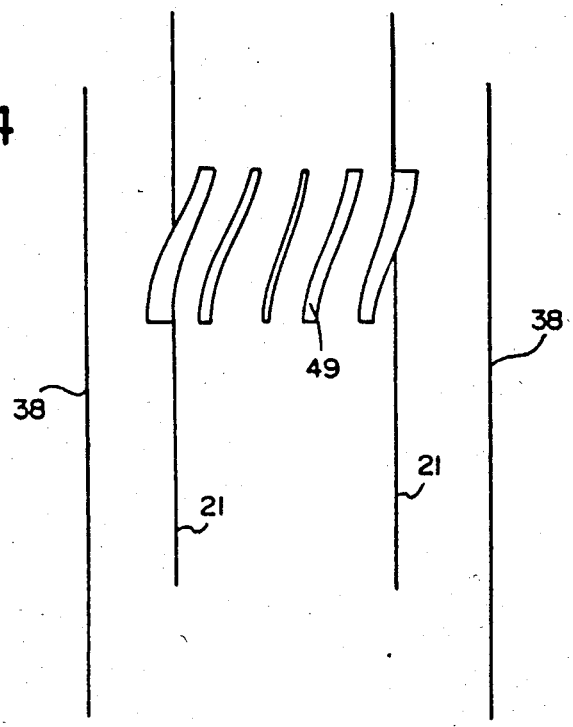
FIG. 4 is a schematic vertical section of a dip tube bearing on the outer surface thereof a plurality of baffles.

In the embodiment of FIG. 4, there are provided in the upper third of the annular passageway 36 of FIG. 2 a plurality of baffles 49 mounted on dip tube 21, which impart to the ascending stream of gas and liquid a circumferential component of velocity whereby the liquid (and the solids contained therein) are subjected to centrifugal force. Clearly these baffles may be mounted in the corresponding portion of the inner perimetric surface of the dip tube; and the baffles may extend across the passageway to a degree sufficient to impart the desired centrifugal force. These baffles serve to assist in heat transfer and to utilize centrifugal force to coalesce the liquid whereby the gas leaving the upper portion of the second cooling zone is denuded to a greater degree of liquid and solids.

EXAMPLE IV

Figure 5:
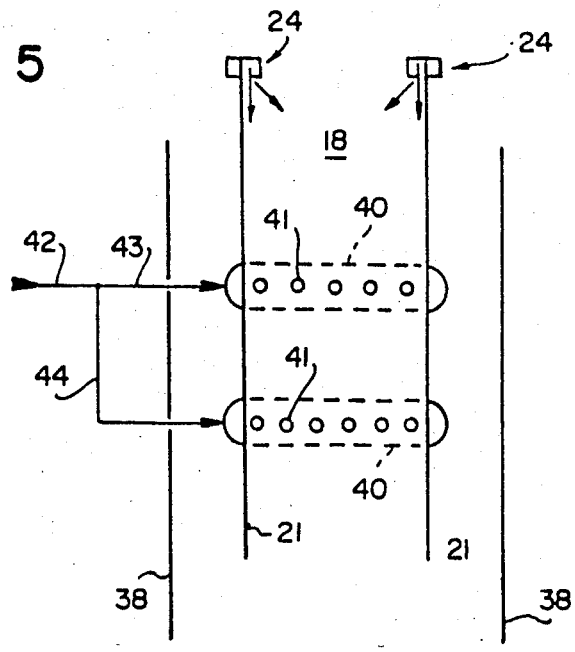
FIG. 5 is a schematic vertical section of a dip tube bearing a spray device for introducing sprayed cooling liquid into the interior of the dip tube.

FIG. 5 shows an alternative embodiment of a portion of the apparatus of FIG. 3. In this schematic sketch, the dip tube 21 is shown bearing a plurality of supplemental spray inlets or rings 40. These rings may be in addition to or in place of the spray nozzles shown in detail in FIG. 1–2. In FIG. 5, each of these rings is mounted on the outer surface of the dip tube 21 and admit liquid spray through a plurality of openings 41 which pass through the wall of dip tube 21. Cooling liquid is admitted through lines 42, 43, and 44.

Although this invention has been illustrated by reference to specific embodiment, it will be apparent to those skilled in the art that various changes and modifications may be made which clearly fall within the scope of this invention.

I claim:

1. A synthesis gas generation apparatus including a vertically extending synthesis gas generator having a lower outlet through which hot synthesis gas is withdrawn;

means defining a vertically extending quench chamber, below said vertically extending synthesis gas generator, having a hot synthesis gas inlet therein joining said lower outlet of said synthesis gas generator whereby hot synthesis gas exits said synthesis gas generator and is admitted to said quench chamber, and an exit conduit at the upper portion of said quench chamber, said quench chamber containing a body of cooling liquid in the lower portion thereof;

an attenuated vertically extending dip tube in said quench chamber having a vertically extending axis, inner and outer perimetric surfaces, and an upper inlet through which hot synthesis gas entering said quench chamber is admitted to said dip tube, through which said gas moves toward a lower outlet end of said dip tube located within said body of liquid;

a quench ring adjacent to the inner perimetric surface at the inlet end of said dip tube, said quench ring having a liquid-inlet;

a liquid outlet on said quench ring for directing a curtain of liquid along the inner perimetric surface of said attenuated dip tube and toward the outlet end of said dip tube;

spray means in said quench ring for directing a stream of liquid away from the inner perimetric surface of said attenuated vertically extending dip tube and toward the axis of said dip tube;

and said quench chamber surrounding said attenuated vertically extending dip tube forming a closed chamber therearound providing an annular passageway therebetween, and said exit conduit comprising a quenched gas outlet adjacent to the inlet end of said attentuated dip tube, and a quench bottoms liquid outlet in said quench chamber adjacent to the outlet end of said dip tube;

whereby charge gas admitted to the inlet end of said attenuated vertically extending dip tube is contacted with liquid from said liquid outlet on said quench ring and said spray means, as the charge gas passes downwardly along the axis of said attenuated dip tube, and thereafter into a body of liquid maintained in said quench chamber, said charge gas leaving said dip tube, passing through the annular passageway between the outside of the outer perimetric surface of the dip tube and the inside of the inner perimetric surface of the quench chamber, and thence to the quench gas outlet of said quench chamber.

2. A synthesis gas generation apparatus including a vertically extending synthesis gas generator having a lower outlet through which hot synthesis gas is withdrawn;

means defining a vertically extending quench chamber, below said vertically extending synthesis gas generator, having a hot synthesis gas inlet therein joining said lower outlet of said synthesis gas generator whereby hot synthesis gas exits said synthesis gas generator and is admitted to said quench chamber, and an exit conduit at the upper portion of said quench chamber, said quench chamber containing a body of cooling liquid in the lower portion thereof;

an attenuated vertically extending dip tube in said quench chamber having a vertically extending axis, inner and outer perimetric surface, and an upper inlet through which hot synthesis gas entering said quench chamber is admitted to said dip tube, through which said gas moves toward a lower outlet end of said dip tube located within said body of liquid;

a quench ring adjacent to the inner perimetric surface at the inlet end of said dip tube, said quench ring having a liquid-inlet;

a liquid outlet on said quench ring for directing a curtain of liquid along the inner perimetric surface of said attenuated dip tube and toward the outlet end of said dip tube;

spray means in said quench ring for directing a stream of liquid away from the inner perimetric surface of said attenuated vertically extending dip tube and toward the axis of said dip tube;

an attenuated draft tube, having inner and outer perimetric surfaces, enveloping said attenuated vertically extending dip tube, and having an outlet end adjacent to the inlet end of said dip tube and an inlet end adjacent to the outlet end of said dip tube, said inlet end of said attenuated draft tube terminating at a distance which is further from the inlet end of said dip tube than is the outlet end of said dip tube;

an annular passage way between the outer perimetric surface of said attenuated dip tube and the inside of the inner perimetric surface of said draft tube;

and said quench chamber surrounding said attenuated vertically extending dip tube and said attenuated draft tube forming a closed chamber therearound, and said exit conduit comprising a quenched gas outlet adjacent to the inlet end of said dip tube, and a quench bottoms liquid outlet in said quench chamber adjacent to the outlet end of said dip tube;

whereby charge gas admitted to the inlet end of said attenuated vertically extending dip tub is contacted with liquid from said liquid outlet on said quench ring and said spray means, as the charge gas passes downwardly along the axis of said attenuated dip tube, and thereafter into a body of liquid maintained in said quench chamber, said charge gas leaving said dip tube, passing through the annular passageway between the outside of the outer perimetric surface of the dip tube and the inside of the inner perimetric surface of the draft tube in said quench chamber, and thence to the quench gas outlet of said quench chamber.

3. A synthesis gas generation apparatus as claimed in claim 2 including a plurality of baffles mounted in the annular passageway between the outside of the outer perimetric surface of the attenuated vertically extending dip tube and the inside of the inner perimetric surface of the draft tube.

* * * * *